US005573182A

United States Patent [19]

Gannaway et al.

[11] Patent Number: 5,573,182

[45] Date of Patent: Nov. 12, 1996

[54] HEAT PUMP HOT WATER HEATER

[75] Inventors: Edwin L. Gannaway; Frank J. Scire, both of Adrian, Mich.

[73] Assignee: Tecumseh Products Company, Tecumseh, Mich.

[21] Appl. No.: 518,079

[22] Filed: Aug. 22, 1995

[51] Int. Cl.[6] ..... F25B 27/00

[52] U.S. Cl. ..... 237/2 B; 62/238.6; 62/295; 62/296

[58] Field of Search ..... 237/2 B; 62/238.6, 62/238.7, 295, 296; 417/382

[56] References Cited

U.S. PATENT DOCUMENTS

| | | | |
|---|---|---|---|
| H8 | 1/1986 | Hays | 62/79 |
| 2,516,093 | 7/1950 | Ruff | 62/238.6 |
| 2,516,094 | 7/1950 | Ruff | 62/238.6 |
| 2,575,325 | 11/1951 | Ambrose et al. | 62/238.6 X |
| 4,091,994 | 5/1978 | Madsen | 237/2 B |
| 4,207,752 | 6/1980 | Schwarz | 62/238.6 |
| 4,290,275 | 9/1981 | Disco | 62/238.6 |
| 4,320,630 | 3/1982 | Uselton | 62/238.6 |
| 4,330,309 | 5/1982 | Robinson | 62/181 |
| 4,363,221 | 12/1982 | Singh | 62/238.6 |
| 4,448,347 | 5/1984 | Dunstan | 237/2 B |
| 4,507,933 | 4/1985 | Chapa | 62/184 |
| 4,513,585 | 4/1985 | Maisonneuve | 62/238.6 |
| 4,517,799 | 5/1985 | Hanaoka et al. | 62/238.6 X |
| 4,959,975 | 10/1990 | Harris | 62/238.6 |
| 5,241,829 | 9/1993 | Irie | 62/79 |

*Primary Examiner*—William E. Tapolcai
*Attorney, Agent, or Firm*—Baker & Daniels

[57] ABSTRACT

A water heater using the heat pump principle includes a hermetic compressor mounted within a well defined within a water tank. The outlet fitting of the compressor is connected to a condensing tube within the tank that heats the water. The compressor includes a radially outwardly projecting flange that is supported on a support surface on the upper header of the water tank through a resilient pad. The pad includes ribs, dimples, or other projections to partially support the flange away from the surface of the pad and/or to support the pad off of the support surface on the header, to thereby vent the volume defined between the compressor and the well.

19 Claims, 2 Drawing Sheets

HEAT PUMP HOT WATER HEATER

BACKGROUND OF THE INVENTION

This invention relates to a water heater in which the water is heated by a heat pump.

Water heaters in which water is heated by the heat pump in principle have been known for many years. One such device is disclosed in U.S. Pat. No. 2,516,094.

Water heaters of this type use a compressor to compress refrigerant in the gaseous state. The refrigerant is then condensed to heat the water, and later evaporated back into the gaseous state. It is desirable to mount the compressor which compresses the refrigerant in a well extending into the hot water tank. In this way, some of the heat generated by operating the compressor can be transferred to the water through conduction, thus further improving the efficiency of the device. However, due care must be taken with such devices that any potential refrigerant leaks do not contaminate the potable water stored in the hot water tank. For this reason, a volume is provided between the compressor and the walls of the well to assure that refrigerant will not enter the water tank. Since heat pump compressors of the type used in such water heaters generate noise through vibration, it is also desirable to provide a noise and vibration isolation pad supporting the compressor to thereby diminish the noise and vibration as much as possible.

SUMMARY OF THE INVENTION

The present invention provides a water heater which is operated on the heat pump principle in which the compressor is mounted in a well within the water tank. The compressor is supported within the well by a flange that extends radially outwardly from the compressor and is supported on a support surface on the upper header of the water heater. An annular resilient pad circumscribes the compressor and is mounted between the flange and the support surface to thereby cushion the noise and vibration generated by the compressor during normal use. Vent paths are provided through the pad to vent the volume between the compressor and the walls of the well to prevent pressure generated by heat created by normal operation of the compressor from building up pressure in this volume to an unacceptable level and to permit any gaseous refrigerant that might collect in this volume to vent to atmosphere.

BRIEF DESCRIPTION OF THE DRAWINGS

These and other advantages of the present invention will become apparent from the following specification, with reference to the accompanying drawings, in which.

DETAILED DESCRIPTION

Figure 1:
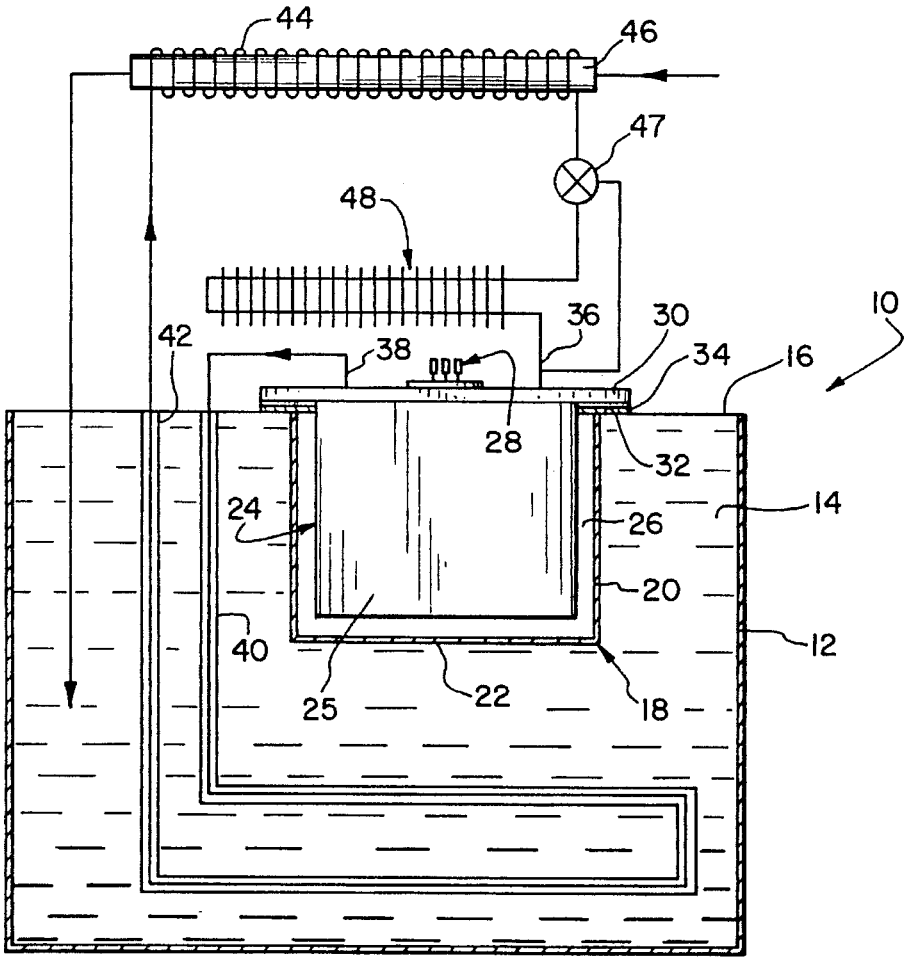
FIG. 1 is a diagrammatic view of a heat pump water heater made pursuant to the teachings of the present invention.

Referring now to the drawings, a water heater system generally indicated by the numeral 10 includes walls 12 defining a water tank 14, the top of which is enclosed by top header 16. The tank 14 holds hot water for distribution in a conventional domestic water system. A well generally indicated by the numeral 18 is defined within the tank 14. The well 18 is defined by a circumferentially extending wall 20 and a bottom wall 22. As discussed above, water in tank 14 is heated by the well known heat pump principle. The heat pump system includes a conventional hermetic compressor 24 having a hermetic outer housing 25 disposed within the well 18 but supported away from the walls 20, 22 to define a volume 26 therebetween. Compressor 24 could be of the type described in U.S. Pat. No. 5,160,247, which is incorporated herein by reference. The volume 26 may either be dead air space or may be filled with a heat transfer medium to transfer heat by conduction through and/or convection from the compressor 24 to the water stored in the tank 14. As is well known to those skilled in the art, operation of the compressor 24 generates substantial heat, and by transferring heat from the compressor itself by conduction, the efficiency of the overall system is improved. Electrical terminals generally indicated by the numeral 28 provide connections for electrical energy used to operate the compressor 24. Compressor 24 is supported within the well 18 by radially outwardly projecting, circumferentially extending flange 30 which overlays a circumferentially extending mounting surface 32 on the top header 18. A circumferentially extending annular pad 34 is disposed between the flange 30 and the supporting surface 32 to thereby dampen vibration and noise generated by operation of the compressor 24. The pad will be described in detail hereinafter with respect to FIGS. 2–7.

The compressor 24 receives refrigerant in the gaseous state at inlet connection 36 and compresses the refrigerant to a high pressure. Compressed refrigerant is then discharged at outlet connection 38. As is well known by those skilled in the art, compression of gas also raises the temperature of the gas significantly. Accordingly, the compressed refrigerant discharged through outlet connection 38 is communicated through condensing tube 40 immersed in the water in the tank 14. The condensing tube 40 is made as long as possible, and may, for example, be in a coiled form, to provide a maximum surface area for communicating heat from the gas to the water stored in tank 14. As the gas is cooled within condensing tube 40 below the heat of vaporization, the refrigerant gas condenses into the liquid state. The refrigerant in the liquid state is communicated from the condensing tube 40 at its connection at the header plate indicated at 42 to an extension 44 of the condenser 44 wrapped around and soldered to the water inlet tube 46 through which cold water to be heated by water heater 10 is communicated into the tank 14. Accordingly, additional heat is extracted from the refrigerant to the cool inlet water to partially heat the latter, thereby even further increasing the efficiency of the overall water system 10. The refrigerant is then communicated through an expansion valve 47 into the evaporator coils indicated schematically at 48. A fan (not shown) blows room air over the evaporator coils 48, which extract heat from the room air to evaporate the refrigerant back into the gaseous state where it is communicated back into the inlet fitting 36 to be again compressed by the compressor 24.

Figure 2:
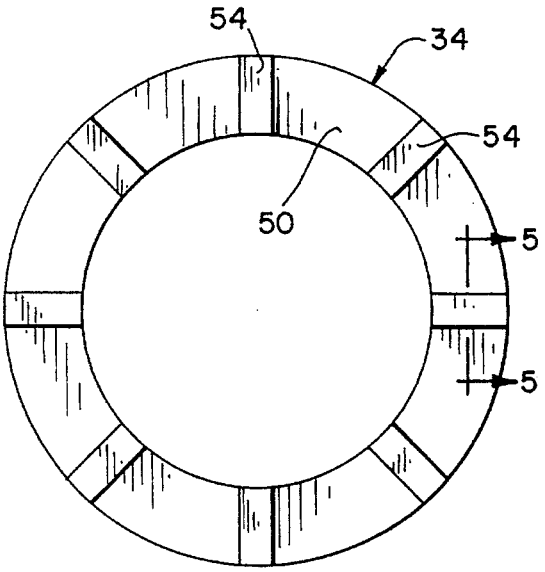
FIG. 2 is top plan view of one embodiment of an isolation pad used in the water heater in FIG. 1.
Figure 5:
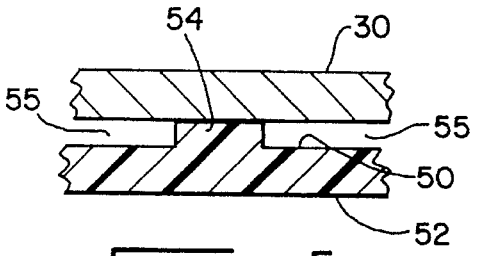
FIG. 5 is a fragmentary cross-section view of the pad taken substantially along lines 5—5 of FIG. 2 and showing the compressor flange.

Referring now to FIGS. 2 and 5, the isolation pad 34 includes an upper support surface 50 which engages the flange 30 and a lower support surface 52, which is supported by the support surface 32. The pad 34 includes circumferentially spaced, radially extending, axially projecting ribs 54 which project upwardly from surface 50 of the pad 34 when the pad is installed as illustrated in FIG. 1, such that the ribs 54 engage the flange 30 and support at least the portions of the latter adjacent,the ribs 54 off of the surface 50 to form vent openings 55 to permit the volume 26 to vent into the room in which the water heating system 10 is installed. Accordingly, expansion of air contained within the volume 26 in response to heating of the air by operation of the compressor 24 is accommodated by venting. Furthermore, any gaseous refrigerant that might collect in volume 26 will escape. The pad 34 is made of rubber, plastic, or equivalent resilient material sufficiently rigid to support the flange, but sufficiently resilient to absorb noise and vibrations generated by operation of the compressor 24, for example pliable neoprene.

Figure 3:
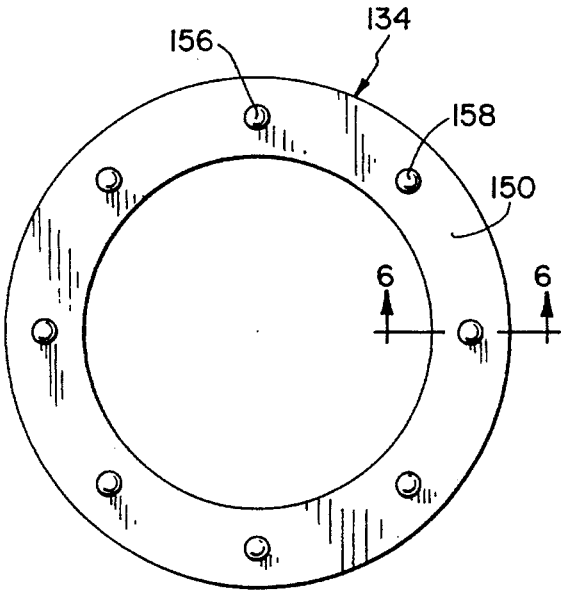
FIG. 3 is a top plan view of a second embodiment of an isolation pad used in the water heater in FIG. 1.
Figure 6:
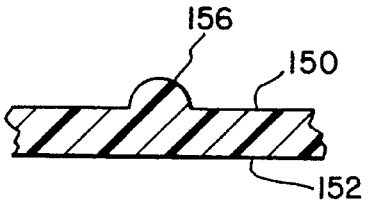
FIG. 6 is fragmentary cross-sectional view taken substantially along lines 6—6 of FIG. 3.

Referring now to the embodiment of FIGS. 3 and 6, elements the same or substantially the same as those in the embodiment of FIGS. 2 and 5 retain the same reference numeral, but are increased by 100. In the embodiment of FIGS. 3 and 6, the ribs 54 in the embodiments of FIGS. 2 and 5 are replaced by circumferentially spaced dimples 156 which project from the surface 150. When the pad 134 is installed in the water heater system in FIG. 1, the dimples 156 engage the flange 30 and support at least the portion of the flange adjacent the dimples 156 away from the surface 150, thereby providing vent passages.

Figure 4:
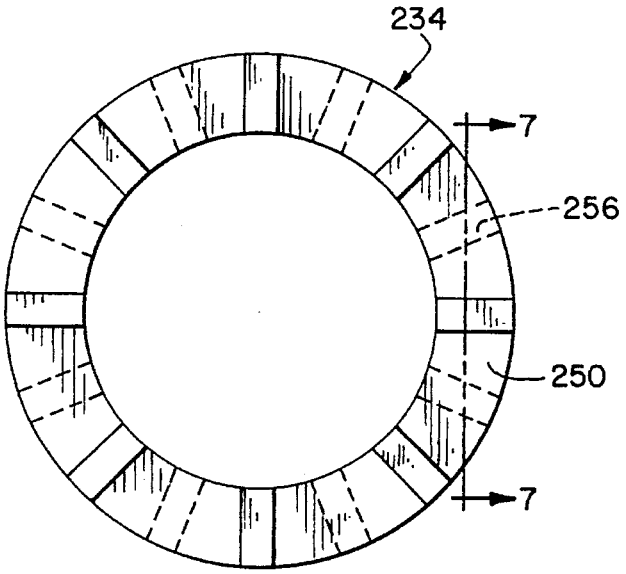
FIG. 4 is a top plan view of a third embodiment of an isolation pad used in the water heater used in FIG. 1.
Figure 7:
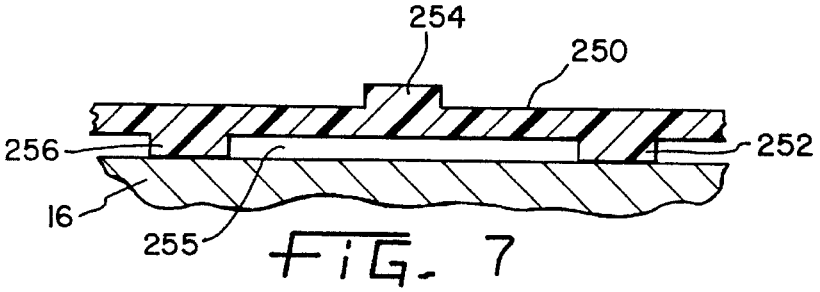
FIG. 7 is a fragmentary cross-sectional view taken substantially along lines 7—7 of FIG. 4 and showing the upper surface of the tank.

Referring now to the embodiment of FIGS. 4 and 7, elements the same or substantially the same as those in the embodiments of FIGS. 2 and 5 retain the same reference numeral, but increased by 200. In the embodiment of FIGS. 4 and 7, circumferentially spaced, radially extending, axially projecting ribs 256 project from surface 252, as well as the ribs 254 projecting from the surface 250. When the pad 234 is installed in the water heating system illustrated in FIG. 1, the ribs 254 engage the flange 30 and the ribs 256 engage the support surface 32. Accordingly, vent passages 255 are provided adjacent the ribs 254 and 256, even though the weight of the compressor is such that portions of the surfaces 250 and 252 between the ribs 254 and 256 are deflected into engagement with the flange 30 and support surface 32. Accordingly, air trapped in the volume 26 is able to vent through the passages 255 defined adjacent the ribs 254, 256.

While this invention has been described as having a preferred design, the present invention can be further modified within the spirit and scope of this disclosure.. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A water heater comprising a hot water tank having a wall defining a water chamber therewithin, said wall including structure defining a well within said water chamber, a hermetic compressor heat transfer mechanism within said well for heating the water in said tank, said compressor mechanism cooperating with said structure to define a volume therebetween, and a resilient mounting member for mounting the compressor mechanism within said well, said resilient member yieldably supporting said compressor mechanism in said well, said resilient member including at least one vent opening for venting said volume.

2. A water heater as claimed in claim 1, including a flange projecting from said compressor mechanism cooperating with a corresponding support area on said wall to support said compressor mechanism within said well.

3. A water heater as claimed in claim 2, wherein said resilient member is located between said flange and said corresponding support area of said wall.

4. A water heater as claimed in claim 3, wherein said flange, said resilient member, and said support area extend circumferentially around said well, said resilient member being an annular, deformable pad.

5. A water heater as claimed in claim 3, wherein said resilient member is an annular, deformable pad having opposed support surfaces, one of said support surfaces engaging said flange, the other support surface engaging said support area, said vent including projections extending from at least one of said support surfaces.

6. A water heater as claimed in claim 5, wherein said projections extend from said one surface to engage said flange, said projections cooperating with said flange to permit venting between said pad and said flange.

7. A water heater as claimed in claim 6, wherein said projections are radially extending ribs projecting from said one surface.

8. A water heater as claimed in claim 6, wherein said projections are circumferentially spaced dimples extending from said one surface.

9. A water heater as claimed in claim 5, wherein said projections extend from said other surface to engage said support area, said projections cooperating with said support area to permit venting between said pad and said support area.

10. A water heater as claimed in claim 9, wherein said projections are radially extending ribs projecting from said other surface.

11. A water heater as claimed in claim 5, wherein said projections extend from each of said surfaces to engage said flange and said support area respectively, said projections cooperating with said flange and said support area to permit venting between said pad and said support area and between said pad and said flange.

12. A water heater as claimed in claim 11, wherein said projections are radially extending ribs projecting from each of said surfaces.

13. A water heater comprising a hot water tank having a header, a well extending into said tank from said header, a compressor heat transfer mechanism in said well for heating the water in the tank, said compressor mechanism cooperating with said well to define a vent volume therebetween, and mounting means for mounting said compressor mechanism within said well, said mounting means including a resilient pad supporting said compressor mechanism, said pad including vent means for venting said volume.

14. A water heater as claimed in claim 13, wherein said mounting means includes a flange extending from said compressor mechanism and a support area for said flange on the header, said pad being mounted between the flange and the support area and having a pair of opposed support surfaces, one of said support surfaces engaging said flange, the other support surface engaging said support area, said vent means including projections extending from one of said support surfaces.

15. A water heater as claimed in claim 14, wherein said projections extend from said one surface to engage said flange, said projections cooperating with said flange to permit venting between said pad and said flange.

16. A water heater as claimed in claim 15, wherein said projections are radially extending ribs projecting from said one surface.

17. A water heater as claimed in claim 16, wherein said projections are circumferentially spaced dimples extending from said one surface.

18. A water heater as claimed in claim 14, wherein said projections extend from said other surface to engage said support area, said projections cooperating with said support area to permit venting between said pad and said support area.

19. A water heater as claimed in claim 18, wherein said projections are radially extending ribs projecting from said other surface.

* * * * *